United States Patent [19]

Gowdy

[11] 4,070,773

[45] Jan. 31, 1978

[54] STEAM IRON WATER VALVE STRUCTURE

[75] Inventor: Harold W. Gowdy, Asheboro, N.C.

[73] Assignee: General Electric Company, Bridgeport, Conn.

[21] Appl. No.: 730,378

[22] Filed: Oct. 7, 1976

[51] Int. Cl.[2] ..... D06F 75/06

[52] U.S. Cl. ..... 38/77.83

[58] Field of Search ..... 38/77.83, 77.5, 77.6, 38/77.7, 77.8, 77.81, 77.82

[56] References Cited

U.S. PATENT DOCUMENTS

| | | | |
|---|---|---|---|
| 2,887,799 | 5/1959 | Kuhn et al. | 38/77.83 |
| 3,496,661 | 2/1970 | Davidson et al. | 38/77.83 |
| 3,497,976 | 3/1970 | Davidson | 38/77.83 |
| 3,823,498 | 7/1974 | Davidson et al. | 38/77.83 |

*Primary Examiner*—Patrick D. Lawson

*Attorney, Agent, or Firm*—John F. Cullen; George R. Powers; Leonard J. Platt

[57] ABSTRACT

The invention discloses a steam iron water valve structure for feeding water into a steam generating chamber. The valve structure adapts the iron for use with any reasonable tap water available by using a scraping or cleaning arrangement of the various orifice and valve structure to remove deposits on each operation and to reduce the vertical extent of the valve travel.

5 Claims, 2 Drawing Figures

STEAM IRON WATER VALVE STRUCTURE

BACKGROUND OF THE INVENTION

1. Field of the Invention

The invention herein pertains to a steam iron and, more particularly, to a novel feed water valve structure between the water tank and the soleplate steam generator to self clean itself of deposits in the water so that tap water in any reasonable locality may be used.

2. Description of the Prior Art

In steam irons a water tank is used above the soleplate and a water valve structure provides controlled water drippage into the steam generator where it is evaporated and directed out soleplate ports to steam the article. Additionally, the water tank may also supply a spray attachment at the front of the iron. Generally, the user is advised to use distilled water because of the fineness of various water passages and orifices which tend to clog due to mineral deposits from the water, which varies locally. Distilled water works well on steam irons since deposits are not plated out of the water onto the metal parts. In hard water localities, the tap water contains minerals which produce loose flakes and deposits that plate out easily onto hot iron components. These deposits varying in various areas of the country generally consist of lime or calcium carbonate as well as other chemicals in solution or in a colloidal suspension. Self-cleaning irons have appeared such as shown in U.S. Pat. No. 3,747,241 of common assignment, where the tank water is suddenly dumped onto the hot soleplate to purge and scrub out the iron prying out the loose deposits and other debris. Other designs blow an extra charge of high pressure steam through the soleplate ports cleaning them. Part of the new self-cleaning concept of applicant's assignee includes cleaning the valve structure per se by a constant scraping action to remove valve deposits which are then carried out of the iron by the self-cleaning action of the U.S. Pat. No. 3,747,241. The two together, purging the tank and passages plus the valve structure cleaning, have provided a self-cleaning iron with much longer life than previously obtainable. The scraping action concept of the metering rod and orifice of the valve structure is disclosed and claimed in U.S. Pat. No. 3,496,661 of common assignment. It is this particular structure that the present invention improves.

SUMMARY OF THE INVENTION

Briefly described, the present invention is directed to specific structural improvements on the U.S. Pat. No. 3,496,661 and is directed to a steam iron with an enclosed fillable water tank and a steam generating soleplate onto which water is dripped through an orifice to generate steam in a generator in the soleplate in normal fashion. There is provided a guided water valve with a stem and metering rod portion that is movable between an on-off position to start and stop water flow from the tank bottom to the soleplate and there is provided an outlet duct from the tank, the duct having a recess extending below the valve, to direct water to the soleplate for steam generation. The valve is designed to prevent the collection of flakes as well as clean the water deposits formed on the critical parts. Generally, the orifice is formed in the top of an upwardly domed plate which is disposed in the bottom of the tank to control and meter water to the steam generator. A tubular stem with a peripheral seal engages the dome of the plate around the orifice to close it and stop the water flow and the metering rod portion is supported pendulum-like in the lower end of the stem. The rod continuously protrudes through the orifice. To this structure, generally shown in the U.S. Pat. No. 3,496,661, the structural improvement comprises the use of a thin sheet metal cup-shaped plate with a flanged rim, the plate being formed with an upwardly-domed bottom with an orifice in the dome. The flange provides a stop for fixedly nesting the plate in the duct above the bottom of the recess so that a separate floating centrally-apertured thin sheet metal scraper plate is disposed in the recess below the cup-shaped plate. While any suitable sheet metal formed to the shape described is satisfactory, stainless steel has been found to be the best and the description proceeds on this basis. The metering rod has dual diameters with the small diameter adapted to scrape in the plate aperture while the large diameter scrapes the orifice on each valve operation. The parts are designed so that the distance between the orifice and scraper plate is less than the total valve travel resulting in a clean scraped stem always being disposed in a clean scraped orifice when the valve is "on" to remove all deposits and provide for continuous accurate water control greatly extending the life of the iron. Additionally, the guided valve is spring-biased in the usual manner and the domed bottom is curved to snugly locate the spring in a fixed position in the cup-shaped plate. Finally, the parts are dimensioned so that the orifice in the dome is preferably no higher than the rim flange to provide short travel of the small diameter rod in the orifice reducing the overall height necessary for valve travel. Thus, the main object of the invention is to provide an improved water valve structure that is self-cleaning, self-guiding, acts as a wick, and inherently tends to repel accumulation of flakes in the valve orifice and does it all in an improved manner over the U.S. Pat. No. 3,496,661 whereby the same structure thereby performs four important functions of metering, guiding, cleaning and flow assisting and greatly improves the life of the iron.

DESCRIPTION OF THE PREFERRED EMBODIMENT

Figure 1:
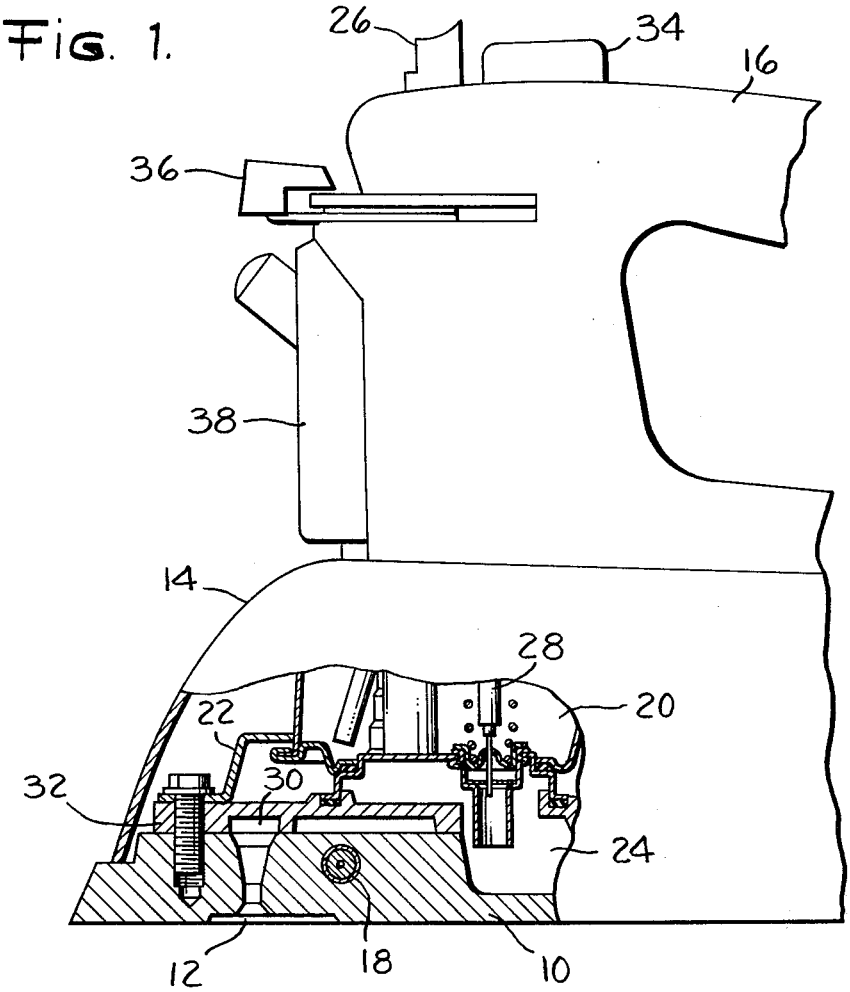
FIG. 1 is an elevational view, partially in section and broken away, showing general parts of an iron and illustrating the invention.

Referring to FIG. 1, there is shown an electric steam iron that may include a spray attachment if desired. The iron includes a soleplate 10 with a plurality of steam ports 12 and an outer shell 14 suitably connected to handle 16 in known fashion. Soleplate 10 conventionally may be cast from aluminum with an electric heating element 18 cast in position and disposed so uniform heat distribution is provided when the iron is plugged in and activated.

The iron includes means for generating steam by providing water tank 20 positioned by bracket 22 and other suitable mechanism in conventional fashion. For steam, soleplate 10 has a steam generator 24 into which, under control of button 26 and guided valve stem 28 movable between an on-off position, water controllably drips from tank 20 onto hot soleplate 10, the resulting steam being distributed through passages 30 under cover 32 and out ports 12 onto the fabric being ironed.

If desired, any spray attachment is operated by control button 34, temperature control 36 thermostatically controls the soleplate heat and fill opening 38 provides direct communication to fill the tank 20 all in a known manner.

Generally, such steam irons preferably use distilled water for best operation because of the purity of the water. However, many operators simply do not use distilled water but use tap water and, depending on the water hardness, in time the water passages become clogged. Some irons use a clean-out pin projecting through the metering orifice to remove scale that accumulates and the collection area around the orifice tends to collect flakes because of the cup-shaped structure employed. When the clean-out pin is removed, flakes funnel into the orifice and clog it affecting its operation. The present invention is designed to improve on the water valve structure heretofore used and is an improvement on the specific invention in the 3,496,661 patent by providing structural changes that greatly improve the life of the iron and its ability to steam at a constant rate for a long time.

Figure 2:
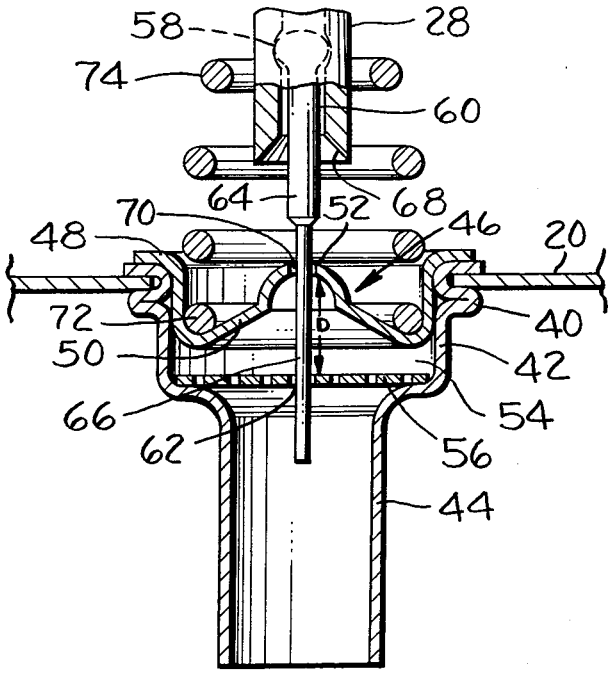
FIG. 2 is a partial cross-sectional view of the water valve structure shown in FIG. 1.

Accumulation of deposits at the metering orifice of the water valve is prevented by providing a protruding element in the orifice at all times thus making the orifice an annular controlled orifice as well as using the protruding member as a wick to assist flow and as a pilot guide and to this end numerous modifications are shown in the U.S. Pat. No. 3,496,661. The preferred FIG. 2 modification of that patent is the one that is improved upon in the instant invention. To this end, there is provided in the bottom of the water tank 20 an opening with an outlet duct 40 provided with a recess 42 and extending below the water tank and the upper valve mechanism by extension 44 to direct water to soleplate generator 24 as shown in FIG. 2 of said U.S. Pat. No. 3,496,661.

In order to provide much longer iron life, nearly doubling the tap water life of the iron, the structural improvements in the present invention comprise the use of a thin stainless cup-shaped plate 46 having a flanged rim 48 that overlies the top of the duct as shown and has an upwardly domed bottom 50 with an orifice 52 in the apex of the dome. The particular shape and material of plate 46 is very significant for the much longer tap water life obtained. Prior constructions have used turned brass plates press-fitted into outlet duct 40 wherein the machine pressing the plate in position was relied upon to locate it properly. With the flanged construction, plate 46 is just pushed into positive stopped position to fixedly nest the plate in and overlapping the duct above the recess bottom and not rely on any friction fit in the duct for positioning. Thus, this always provides a positive dimensioned chamber 54 in the recess below the plate 46. The use of stainless also permits a sheet metal part of relatively thin dimensions — about 0.50 mm — and this is what is meant by "thin" as used in the claims. This sheet metal plate has several inherent advantages, to be fully explained, over the turned part previously used. For guiding and scraping, there is also provided a separate floating centrally-apertured thin stainless scraper plate 56 in the chamber portion 54 of the recess that, with the flanged construction, is formed below cup-shaped plate 46. Thus, plate 56 has freedom to float with no binding action in the chamber 54 since plate 46 is permanently stopped in the recess well above its bottom. This scraper plate is in the order of 0.38 mm and is also made of stainless steel.

In order to utilize the stainless plate structure effectively, stem portion 28 of the water valve carries the lower metering rod portion as in the U.S. Pat. No. 3,496,661 patent in a pendulum-like arrangement 58 for continuous alignment of rod 60 in orifice 52 and central aperture 62. For continuous accurate water control over a long life, the metering rod portion 60 carried by stem 28 has dual large and small diameters 64 and 66 with the rod always protruding through both orifice 52 and aperture 62. Thus, the metering rod is free to center and locate itself by its presence in aperture 62. For sealing in the off-position, the bottom of stem 28 has a sealing periphery 68 mating with the upper portion of domed plate 46 around the orifice to provide a good seal and is preferably formed with a bulbous portion for a ball joint seal.

For continuous cleaning, large diameter 64 is the same diameter as orifice 52 thus scraping the orifice on each valve operation. Similarly, the cross-section of aperture 62 is the same as small diameter 66 thus scraping it also on each valve operation. Thus, both water control structural parts of small diameter 66 and orifice 52 are continuously and simultaneously scraped on each valve operation to provide a constant annulus 70 for continuous accurate water metering. Further, in order to prevent any possibility of binding, the domed bottom of plate 46 is formed or curved at 72 to snugly locate the bottom of biasing spring 74 which biases stem 28 in the usual manner. This forming of the curved portion of the plate to positively seat and locate the spring in a fixed position prevents any riding or movement of the spring along the domed surface to possibly jam operation and this advantage is obtained by properly forming plate 46 to the shape noted.

For constant metering by cleanly scraped parts, the valve structure is dimensioned critically in that the distance D between orifice 52 and scraper plate 56 is always less than the total valve travel up and down so there is always a scraped orifice 52 operating in conjunction with a scraped rod 66 for accurate water control i.e. there is no danger that an unscraped portion 66 can enter orifice 52 if this distance D is always less than the total valve travel. Further, to reduce the overall height of the structure, while not necessary if the distance D is maintained, it is advantageous to maintain the orifice 52 in the dome at or below rim flange 48 so that there is a short travel of the small diameter 66 in the orifice.

The use of the preferred stainless steel plate 46 has several inherent advantages over a turned metal part in being of lower cost. More importantly, the length of the orifice 52 is reduced to the thickness of the sheet metal and this cannot be obtained practically with a turned part that would be as thin. The short length orifice possible provides a better scraping edge to cooperate with metering rod 62 to keep the orifice clean and allow chips and flakes to fall away with less chance of binding the metering rod in the orifice because of its short length. With a relatively long length orifice, small flakes can jam in the orifice but with the shorter length available there is provided a sharper orifice with cleaner scraping action. Further, stainless steel permits better wear resistance so that there is little or no distortion or elongation of the metering orifice such as making the orifice elliptical in which case the steam rate gets too high and the iron consequently will drip. Also, such elliptical wear permits the parts to get out of line with the bottom scraper. Then the entire valve structure can bind, bending the metering rod and resulting in shorter life. Still further, stainless steel, with its inherent lower thermal conductivity tends to reduce the build-up of tap water deposits since the minerals plate out faster at higher temperatures. Thus, the part runs cooler with no plating out of minerals and reduced possibility of jamming the orifice. Finally, the dimensioning of the parts as described avoids the disadvantage of not cleaning enough length of the small diameter 66 of the metering rod when the valve is fully open permitting any small uncleaned diameter to be still in the orifice so that an unscraped part is in the orifice to prevent good metering and restricting the flow. By reducing the travel so that D is always less than the valve travel it ensures having a cleaned rod part in a cleaned orifice at all times and thus a constant metering annulus. With the particular forming of plate 46 for the snug fit of the spring, it prevents the spring from riding up the dome of the valve seat preventing stem 28 from sealing to completely shut off the flow as opposed to a flat seat for the spring as in the prior art. This also helps during assembly of the iron in the manufacturing operation since the valve stem assembly is properly positioned. Finally, the flange portion on plate 46 positively positions the plate in the recess and does not rely on a friction fit so that the parts are more easily assembled by machine by just pressing down against the stop. This ensures that D is always the same and that plate 56 is always assured of centering and for always properly scraping small diameter 66.

While there has been described a preferred form of the invention, some equivalent variations may be possible in light of the above teachings. It is therefore to be understood that, within the scope of the appended claims, the invention may be practiced otherwise than as specifically described, and the claims are intended to cover such equivalent variations.

I claim:

1. In a steam iron having a water tank, steam generating soleplate, a guided water valve with a stem and metering rod portion movable between an on-off position and an outlet duct from the tank having a recess and extending below said valve directing water to the soleplate for steam generation, the improvement comprising:

a thin stainless steel sheet metal cup-shaped plate with a flanged rim overlying the duct and an upwardly-domed bottom with an orifice in the dome;

said flange fixedly nesting the plate in the duct above the recess bottom;

a separate floating centrally-apertured thin stainless steel scraper plate in the recess below the cup-shaped plate;

said metering rod portion carried by the stem and having dual diameters with the rod continuously protruding through said orifice;

the small diameter adapted to scrape in the plate aperture and large diameter scraping the orifice;

the distance between orifice and scraper plate being less than the total valve travel so both orifice and small diameter are simultaneously scraped on each valve operation and a scraped rod is always disposed in a scraped orifice in valve-on position for continuous accurate control.

2. Apparatus as described in claim 1 wherein said guided valve includes a spring biasing said stem having a sealing periphery at its lower end mating with said dome in water-off position.

3. Apparatus as described in claim 2 wherein said metering rod portion is supported pendulum-like in the lower end of said stem.

4. Apparatus as described in claim 3 wherein said domed bottom is curved to snugly locate the spring in a fixed position in said cup-shaped plate.

5. Apparatus as described in claim 4 wherein the orifice in said dome is no higher than the rim flange for short travel of said small diameter in the orifice.

* * * * *